US006072170A

United States Patent [19]

Fish

[11] Patent Number: 6,072,170

[45] Date of Patent: Jun. 6, 2000

[54] SWITCH PARTICULARLY SUITED FOR IMAGE INTENSIFIER TUBE SYSTEM

[75] Inventor: Franklin H. Fish, Indianapolis, Ind.

[73] Assignee: The United States of America as represented by the Secretary of the Navy, Washington, D.C.

[21] Appl. No.: 09/183,967

[22] Filed: Nov. 2, 1998

[51] Int. Cl.[7] ..... H01J 31/50

[52] U.S. Cl. ..... 250/214 VT; 250/207; 250/214 R

[58] Field of Search ..... 250/214 VT, 214 R, 250/207, 214 LA; 313/532, 537, 103 R, 103 CM, 104, 105 R, 105 CM

[56] References Cited

U.S. PATENT DOCUMENTS

| | | | |
|---|---|---|---|
| 4,166,213 | 8/1979 | Hoover | 250/214 VT |
| 4,734,573 | 3/1988 | Dill | 250/214 VT |
| 5,495,364 | 2/1996 | Palmer | 250/214 VT |
| 5,883,381 | 3/1999 | Saldana | 250/214 VT |
| 5,949,063 | 9/1999 | Saldana et al. | 250/214 VT |

*Primary Examiner*—John R Lee
*Attorney, Agent, or Firm*—Ron Billi

[57] ABSTRACT

A cathode switch particularly suited for an image intensifier tube (IIT) is disclosed. The cathode switch provides cathode pulses to turn "on" and turn "off" the IIT tube and does so with reduced power consumption and with reduced noise generated by associated high voltage switching.

3 Claims, 11 Drawing Sheets

FIG−2
PRIOR ART

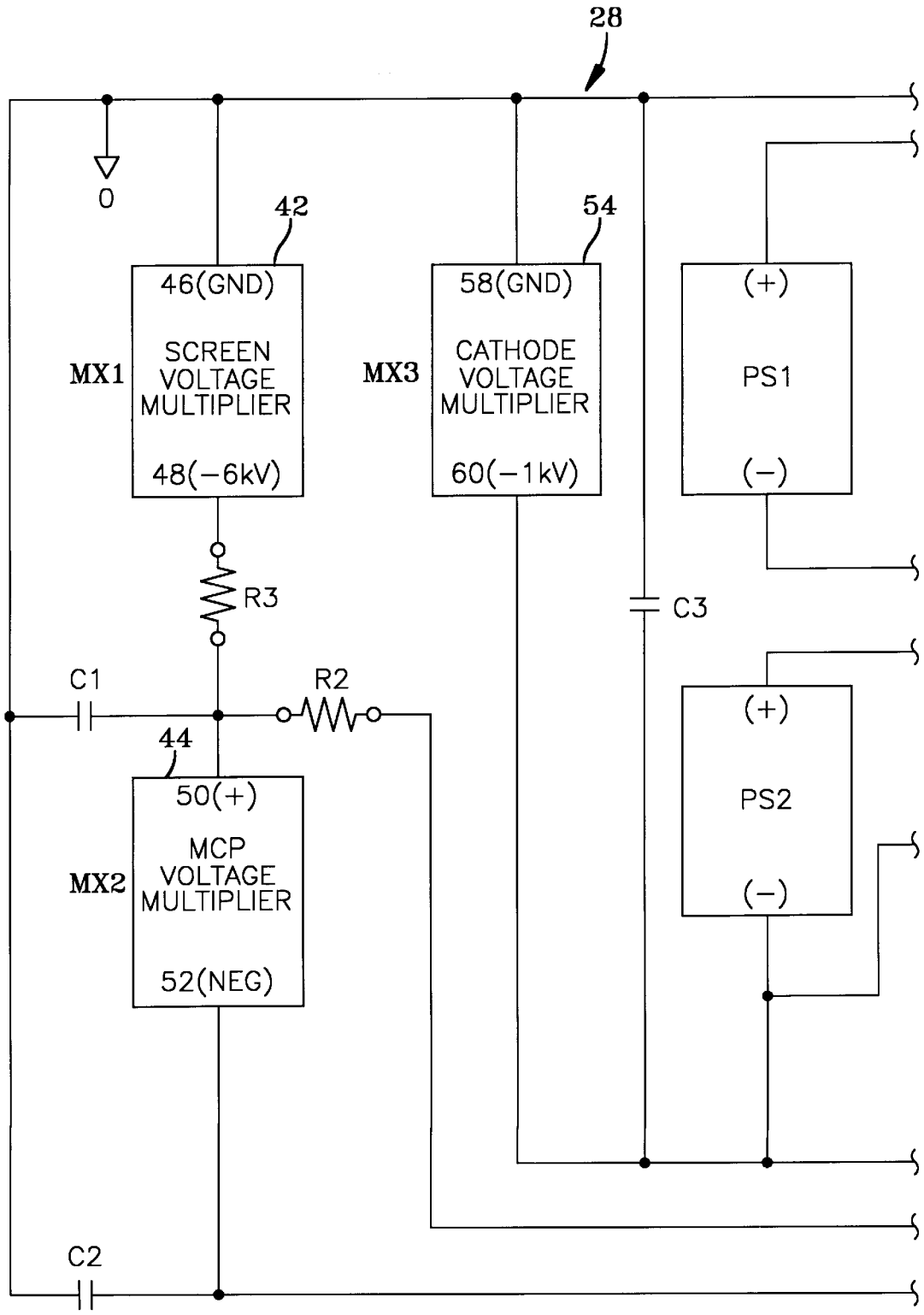
FIG−5A

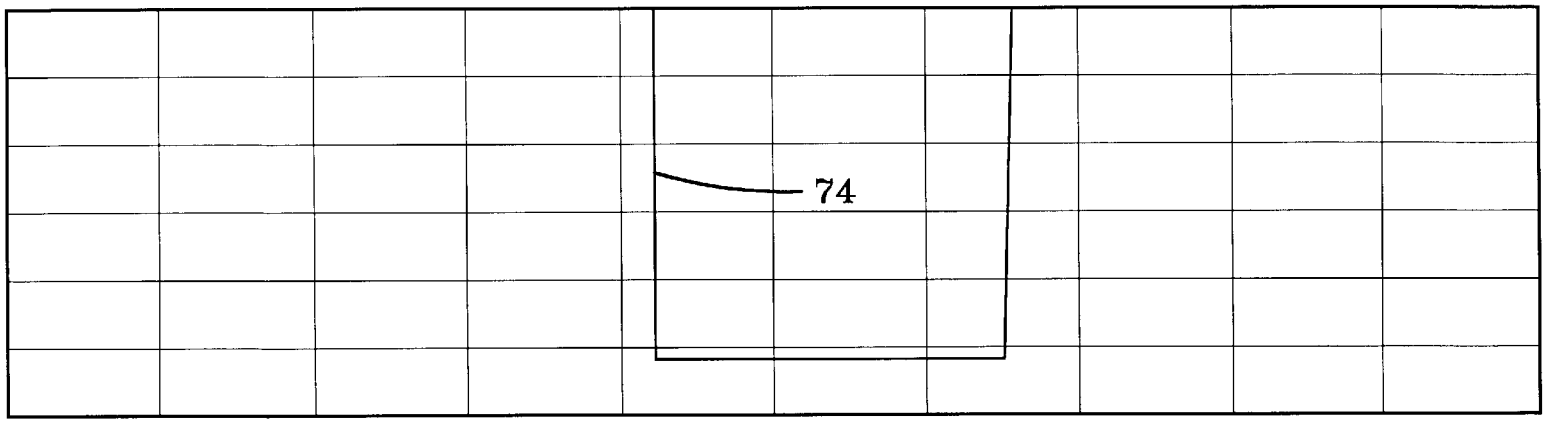
FIG-8(A)
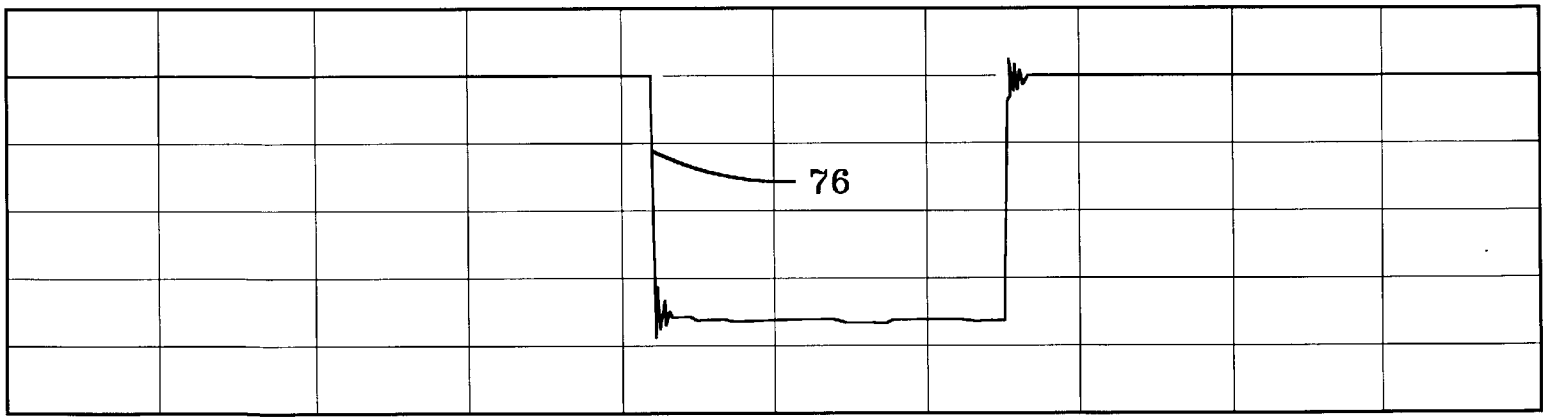
FIG-8(B)
FIG-8

SWITCH PARTICULARLY SUITED FOR IMAGE INTENSIFIER TUBE SYSTEM

STATEMENT OF GOVERNMENT INTEREST

This invention described herein may be manufactured and used by or for the Government of the United States of America for governmental purposes without the payment of any royalties thereon or therefor.

BACKGROUND OF THE INVENTION

The present invention is related to an image intensifier tube (IIT) system particularly suited for night vision and, more particularly, to an IIT system having a cathode switch for an IIT system with reduced power consumption and reduced noise generated by associated high voltage switching.

Image intensifier tubes that operatively cooperate with high voltage power supplies so as to form a night vision system having light amplification are known. Although these image intensifier tubes serve well their intended purpose they are sometimes plagued by relatively high power consumption and noise generated by high voltage switching.

In the majority of night vision applications, image intensifier tubes are operated in a continuous "on" mode. Light gain is controlled by varying the voltage applied across one of the IIT system's major elements, that is, across the micro channel plate (MCP).

In certain applications, which require wide dynamic range and/or movement of the platform of the IIT system, it is necessary to also control tube "on" time. This is accomplished by a cathode switch that controls the voltage applied between the cathode and micro channel plate (MCP) elements of the IIT system. The cathode switch is a relatively complicated circuit which is floating at high voltage. A typical implementation is comprised of an output switch stage, a switch driver circuit, a memory element, an isolated gate receiver circuit, and a number of floating power supplies. A typical implementation utilizes 67 discrete components, including 13 transistors. A major disadvantage of this approach is that it utilizes complex low voltage circuitry which is floating at high voltage requiring all power and signal lines interfaces to possess high voltage isolation. It is desired to provide a cathode switch for an IIT system having reduced complexity, reduced power consumption and reduced high voltage switching noise.

SUMMARY OF THE INVENTION

The present invention is directed to a night vision system employing an imager intensifier tube but also having a cathode switch with reduced complexity, reduced power consumption and reduced high voltage switching noise.

The vision system comprises an image intensifier tube having four terminals and includes a photocathode having a first terminal at one of its ends, a micro channel plate having second and third terminals at one of its ends, and an anode having a fourth terminal at one of its ends. The vision system further comprises a high voltage power supply comprising a micro channel plate voltage multiplier, a screen voltage multiplier, a cathode voltage multiplier and a cathode switch. The micro channel plate voltage multiplier has positive and negative terminals. The negative terminal thereof is connected to the second terminal of the micro channel plate and the positive terminal thereof is connected to said third terminal of the micro channel plate preferably by way of a capacitor C1 and resistor R2 each having a first end connected to the positive terminal and with the second end of the capacitor C1 connected to a ground potential and the second end of resistor R3 connected to the third terminal. The negative terminal thereof is preferably further connected to one end of a capacitor C2 which has its other end connected to a ground potential.

The night vision system preferably comprises a pair of oppositely poled diodes CR1 and CR2 with one end of the pair connected to the first terminal of the photocathode and the other end of the pair connected to the second terminal of said micro channel plate. The screen voltage multiplier develops a negative voltage at one of its terminals connected to the first side of the capacitor C1. The screen voltage multiplier has a ground potential at another one of its terminals. The cathode voltage multiplier has a ground (gnd) and a negative (–) terminal and develops a negative voltage between the negative and ground terminals and preferably has a capacitor C3 arranged across its negative and ground terminals. The cathode switch has a common and a control terminal, the common has a first and second end with the first end connected to the first terminal preferably by way of the capacitor C4. The common has its second end switchable between ON and OFF positions in response to a gate signal applied at the control terminal. The ON position is connected to the negative terminal of the cathode voltage multiplier and the OFF position is connected to the first terminal preferably by way of a resistor R1.

BRIEF DESCRIPTION OF THE DRAWINGS

FIG. 8 is composed of FIGS. 8(A) and 8(B) and illustrates various waveforms involved in analysis of the cathode switch of the present invention.

DETAILED DESCRIPTION OF THE PRESENT INVENTION

Figure 1:
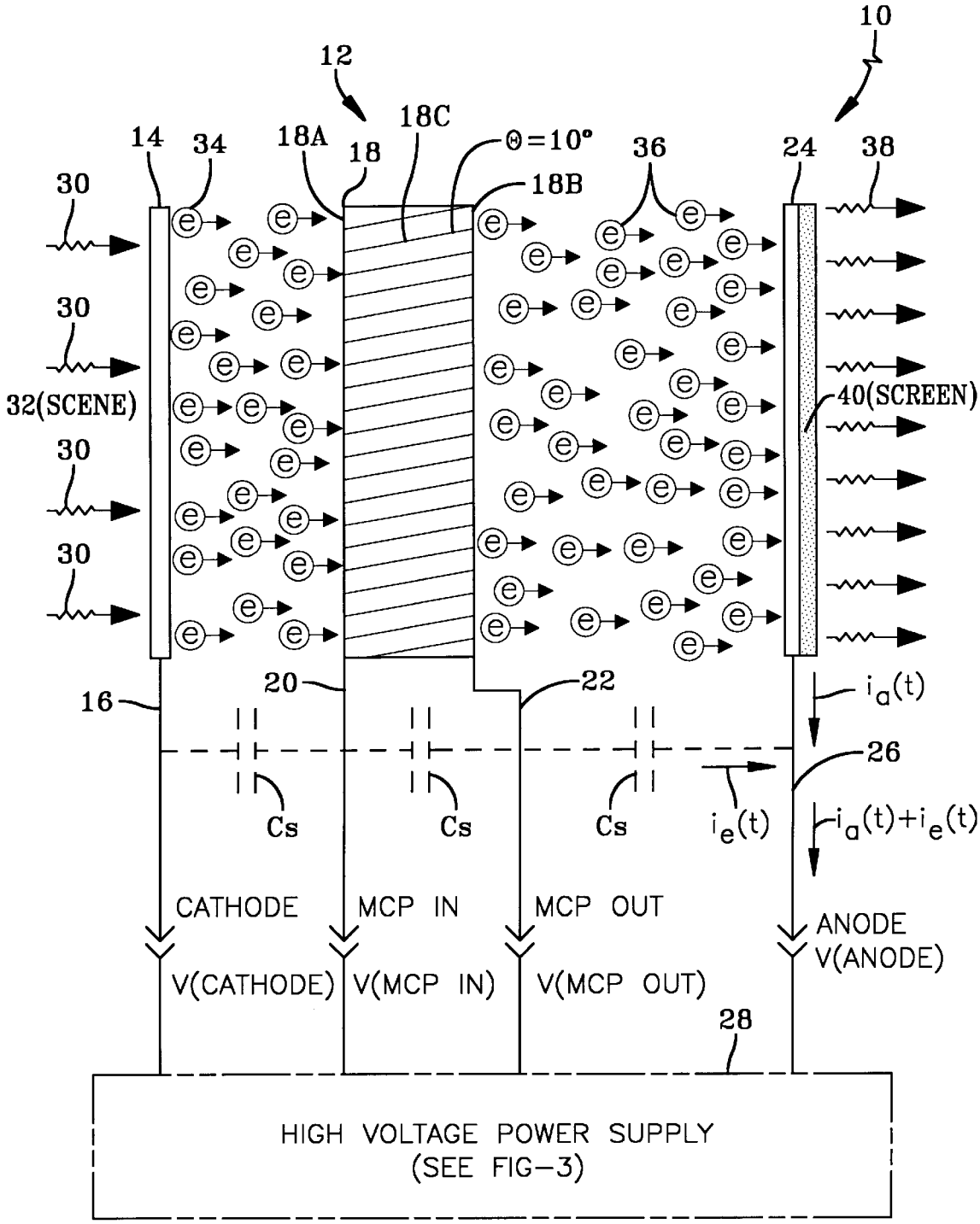
FIG. 1 is a block diagram primarily illustrating the image intensifier tube (IIT) system of the present invention.

With reference to the drawings, wherein the same reference number indicates the same element throughout, there is shown in FIG. 1 a block diagram of the system 10 particularly illustrating the image intensifier tube 12 of the present invention. The image intensifier tube has four terminals and comprises a photocathode 14 having a first terminal 16 at one of its ends, a micro channel plate (MCP) 18 with an entrance or face 18A and an exit or face 18B and having second and third terminals 20 and 22 at one of its ends, and an anode 24 having a fourth terminal 26 at one of its ends. The terminals 16, 20, 22 and 26 extend into the high voltage power supply 28 of FIG. 3. The terminal 16 is further indicated by the terminology CATHODE, v (CATHODE);

terminal 20 is indicated by the terminology MCP IN, v (MCP IN); terminal 22 is indicated by the terminology MCP OUT, v (MCP OUT); and terminal 26 is indicated by the terminology ANODE, v (ANODE).

In operation, photons 30, emanating from a scene 32, impinge the photocathode 14 and create electrons 34. If a negative bias is applied between the cathode first terminal 16 and the second terminal 18 (MCP IN), the IIT tube 12 is "on" and electrons 34 are then accelerated toward the face 18A of the MCP 18. A positive cathode bias voltage applied to the terminal 16 by means of HVPS 28, prevents electrons from reaching the face 18A of the MCP 18 and the IIT tube 12 is "off." The MCP 18 functions as an electron multiplier. More particularly, the MCP 18 consists of millions of small, hollow glass tubes bonded together. The length to diameter ratio of the individual tubes of the MCP 18 is approximately 40. Metal electrodes are deposited on both faces 18A and 18B of the MCP 18 array. A voltage applied across the MCP, that is, across terminals 20 and 22 by the HVPS 28, causes a strip current to flow which results in a charge being stored on the inside walls of the hollow glass tubes, 18C. The amount of stored charge is directly proportional to the magnitude of the voltage applied across terminals 20 and 22.

As seen in FIG. 1, the glass tubes, illustrated as sloped boxes, are angled, as shown by angle Θ, at approximately 10 degrees with respect to the axis (not shown) of the IIT tube 12 so that electrons 34 accelerated into the array will strike the tube walls, such as 18C. The electrons 34 striking the tube walls, such as 18C, of the MCP 18 cause the generation of secondary electrons resulting in electron gain of the MCP 18. A high voltage is also applied between MCP OUT and the screen of the IIT 12, that is, across terminals 22 and 26 causing the electrons 36 which exit the MCP 18 at face 18B thereof to be accelerated toward the screen 40 which is deposited on the face of the anode (shaded area). As the electrons 36 strike the anode 24, the electrons 36 are collected as a screen current $i_a(t)$. The screen 40 has a phosphor coating which the striking electrons 36 excite resulting in the emission of photons 38. Since the IIT tube 12 is constructed to be spatially coherent, the image at the screen 40 is an amplified recreation of the image at the photocathode, that is, scene 32.

Figure 2:
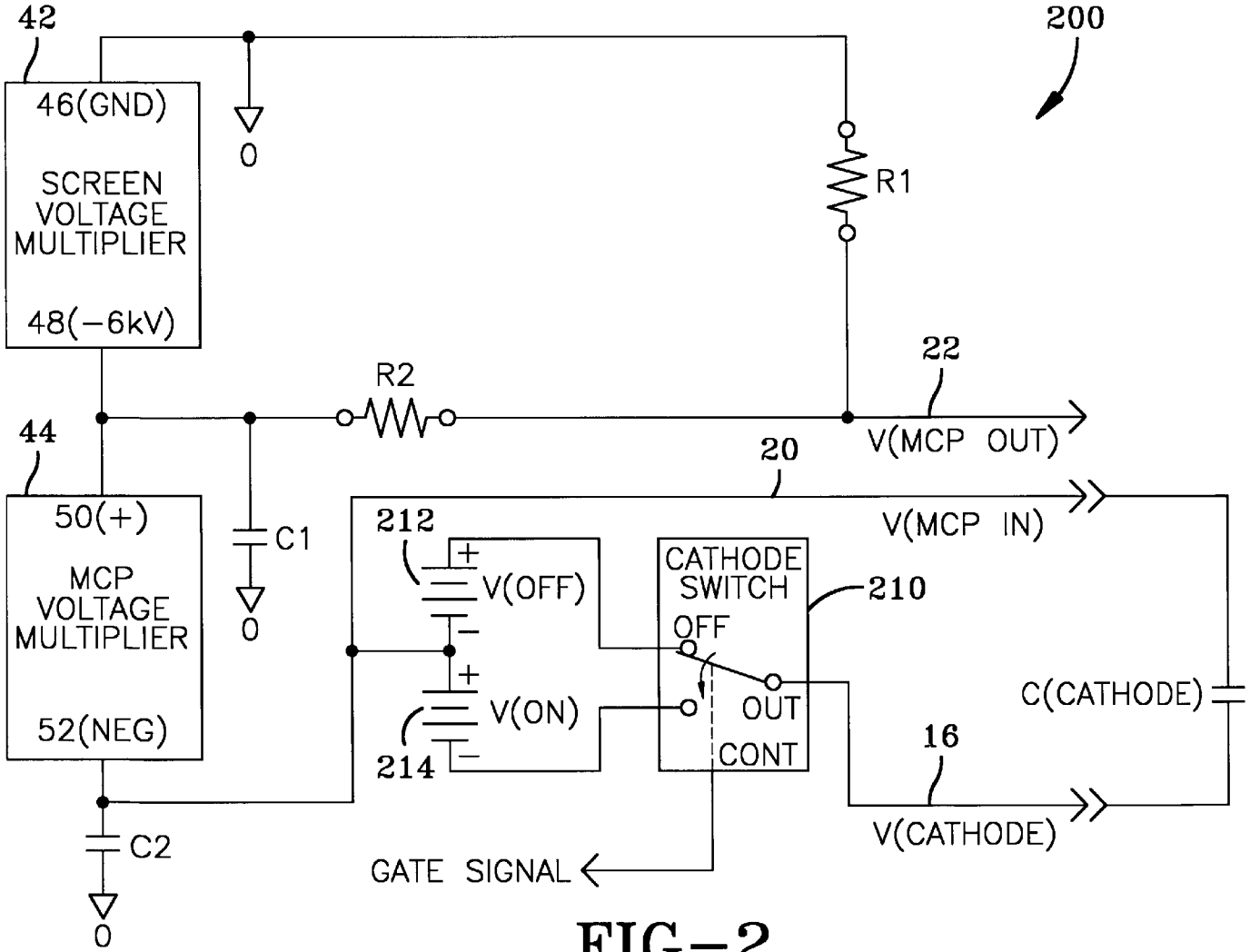
FIG. 2 is an arrangement of a prior art cathode switch of an IIT system.

As discussed in the "Background" section, in the majority of night vision applications, image intensifier tubes are operated in a continuous "on" mode. Light gain is controlled by varying micro channel plate, (MCP), voltage. In certain special applications which require wide dynamic range and/or movement of the platform carrying the IIT system, it is necessary to also control tube "on" time. This is accomplished by controlling the cathode to MCP IN voltage. The basic circuit configuration used in prior art IIT high voltage power supply 200 is shown in FIG. 2 comprised of a plurality of elements having a general description or being of the type given in Table 1.

TABLE 1

| ELEMENT | GENERAL DESCRIPTION/TYPE |
|---|---|
| 42 | SCREEN VOLTAGE MULTIPLIER |
| 44 | MICRO CHANNEL PLATE (MCP) MULTIPLIER |
| 210 | CATHODE SWITCH |
| 212 | NEGATIVE POWER SOURCE OF ABOUT 20 TO 60 VOLTS d.c. |
| 214 | POSITIVE POWER SOURCE OF ABOUT 180 VOLTS d.c. |

TABLE 1-continued

| ELEMENT | GENERAL DESCRIPTION/TYPE |
|---|---|
| R1 | 100 Ω |
| R2 | 1K |
| C1 | 1000 pf |
| C2 | 4000 pf |

As seen in FIG. 2, the high voltage supply 200 includes a screen voltage multiplier 42 and a MCP voltage multiplier 44, both to be further described with reference to FIG. 3, and wherein the screen voltage multiplier 42 has a ground (gnd) terminal 46 and a negative (−6KV) terminal 48 and the MCP voltage multiplier has a positive (+) terminal 50 and a negative (neg) terminal 52.

As further seen in FIG. 2, the cathode switch 210 circuitry is floating, but is referenced to the V(MCP IN) potential supplied by the MCP voltage multiplier 44, which is nominally 7000 volts below ground. When the cathode switch is in the "off" position, the cathode is biased positive by power source 212 with respect to the MCP IN voltage which turns the IIT tube 12 "off." This bias voltage is typically in the range of 20 to 60 volts. The IIT tube 12 is turned "on" by applying a negative potential, supplied by power source 214, to the cathode, via terminal 16, of the IIT system. In one embodiment an "on" voltage of 180 volts is typically required. The cathode switch 210 is controlled by a gate signal, typically generated by a timing subsystem of the IIT system, which is referenced to ground.

The prior art cathode switch 210 requires a relatively complicated circuit so as to be "floating" at high voltage. A typical implementation is comprised of an output switch stage, switch driver circuit, memory element, isolated gate receiver circuit, and a number of floating power supplies. Switch "on" time varies from less than 1 μsec to 1000 μsecs. Turn "on" and turn "off" times must be in the order of 100 nsecs. The general requirement is for relatively high speed switching of hundreds of volts while consuming minimum average power. One prior art cathode switch 210 utilizes 67 discrete components including 13 transistors. In one application of the cathode switch 210, a 240 volt output is switched in less than 100 nsecs, and total power consumption is less than 250 mWatts. A circuit of this type is relatively difficult to implement, as it requires critical tradeoffs between many interrelated and conflicting requirements such as: fast switching, large voltage swings, low power consumption, high voltage isolation, high circuit impedance, noise immunity, fault protection, complexity, size, etc. The major disadvantage of this approach is that it utilizes complex low voltage circuitry which is floating at high voltage. Further, all power and signal lines interfaces require high voltage isolation to maintain the floating condition of the cathode switch 210.

In another application, the cathode switch 210 is desired to supply a cathode "on" voltage of nearly 900 volts with 100 nsec switching times. This requirement results in increased circuit complexity and power consumption. In addition, the cathode signal swing of 900 volts in less than 100 nsecs generates severe noise transients which couple to the input drive signals commonly causing very serious noise interference problems. The present invention provides a cathode switch circuit which yields a solution to the problems outlined above. The cathode switch of the present invention is referenced to ground eliminating the need of floating at high voltages, thereby, greatly simplifying the power and signal interfacing. The practice of the present invention may be further described with reference to FIG. 3 illustrating a plurality of elements some already shown in FIG. 2 and with the additional elements identified in Table 2.

TABLE 2

| ELEMENT | GENERAL DESCRIPTION/TYPE |
|---|---|
| 54 | CATHODE VOLTAGE MULTIPLIER |
| 56 | CATHODE SWITCH |
| C3 | 20 nf |
| C4 | 1000 pf |
| CR1 | ZENER DIODE VS 1490 |
| CR2 | ZENER DIODE IN 6276A |

The practice of this invention applies a voltage control signal to the cathode terminal 16 of an image intensifier tube (IIT), so as to switch the tube "on" and "off" in a manner normally accomplished by an exposure control circuit. The cathode voltage, applied to the cathode terminal 16, is referenced to the micro channel plate input, (MCP IN) present on terminal 20 and which voltage is typically six (6) to seven (7) thousand volts below ground potential. A small cathode to MCP IN positive voltage present on the OFF position of the cathode switch 56 of the present invention turns the IIT tube 12 "off." Several hundred volts negative potential present on the ON position of the cathode switch 56 is desired to turn the IIT tube 12 "on."

Figure 3:
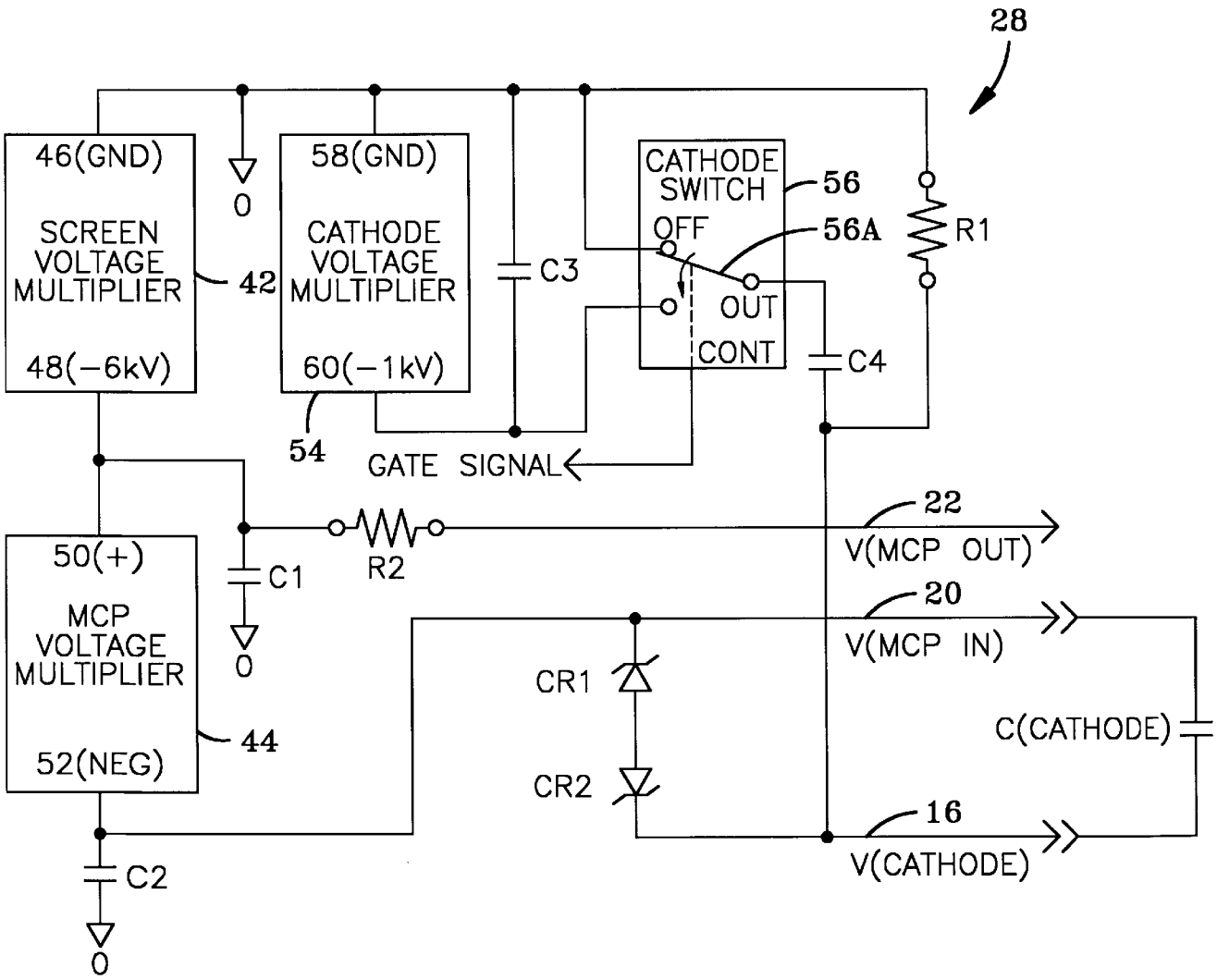
FIG. 3 is an arrangement of the cathode switch of the present invention within a high voltage power supply.

In general, the high voltage power supply 28 of FIG. 3 of the present invention comprises a micro channel plate (MCP) voltage multiplier 44 having position and negative terminals 50 and 52 respectively and develops a voltage between its positive and negative terminals 50 and 52. The negative terminal 52 is connected to the second terminal 20 of the micro channel plate 18 and the positive terminal 50 is connected to the third terminal 22 of the micro channel plate 18 preferably by way of a capacitor C1 and resistor R2 each having a first end connected to the positive terminal 50 and with the second end of capacitor C1 connected to a ground potential and the second end of resistor R3 connected to the third terminal 22. The negative terminal 52 is further connected to one end of a capacitor C2 which has its other end connected to a ground potential.

The high voltage power supply 28 preferably has a pair of oppositely poled diodes CR1 and CR2 with one end of the pair connected to the first terminal 16 of the photocathode of the IIT 12 and the other end of the pair of diodes CR1 and CR2 connect to the second terminal 20 of the micro channel plate 18.

The high voltage power supply 28 has a screen voltage multiplier 42 which develops a negative voltage at its terminal 48 that is connected to the first side of the capacitor C1. The screen voltage multiplier 42 has a ground potential at another one of its terminals 46.

The high voltage power supply 28 also has a cathode voltage multiplier 54 which has ground (gnd) and negative (–) terminals 58 and 60, respectively, and develops a negative voltage between the negative and ground terminals 58 and 60. The cathode voltage multiplier 54 preferably has a capacitor C3 arranged across its negative and ground terminals 58 and 60.

The high voltage power supply 28 further has a cathode switch 56 which is of particular importance and has a common 56A and a (cont) control terminal. The common 56A has a first and second end with the first end connected to an output (OUT) terminal of the cathode switch 56 connected to the first terminal 16 of the photocathode 14 by way of capacitor C4 and its second end switchable between ON and OFF positions in response to a gate signal applied at said control terminal. The ON position is connected to the negative terminal 60 of the cathode voltage multiplier 54 and the OFF position is connected to the first terminal 16 of the photocathode 14 preferably by way of a resistor R1.

FIG. 3 is a simplified block diagram showing the interrelationships of the cathode switch 56 within the high voltage power supply 28 of the present invention. From FIG. 3, it is seen that the cathode switch 56 (OFF position) is referenced to ground. In this implementation, the positive terminal 58 (with respect to terminal 60) of the cathode voltage multiplier 54 is tied to ground. The energy required for the cathode pulse that turns "on" the IIT tube 12 is stored on capacitor C3, which has a very high capacitance value. When the cathode switch 56 is in the "off" position, one terminal of high voltage capacitor C4 is tied to ground. The other terminal of capacitor C4 is connected to the cathode output line, that is, terminal 16. The high voltage resistor R1 is permanently connected from ground to the cathode line, that is, terminal 16. A d-c current path exists from the MCP IN line (terminal 20) to ground via diodes CR1 and CR2, and resistor R1. The zener diode CR1 conducts in the forward direction, while diode CR2 is in the zener breakdown mode. The net voltage drop is approximately 20 volts. The cathode terminal 16 is, therefore, 20 volts positive with respect to the MCP IN terminal 20. This provides the positive bias necessary to turn the IIT 12 "off." Under these conditions, the voltage across capacitor C4 is nominally equal to the MCP IN voltage at terminal 20. When the cathode switch 56 is moves to the "on" position, capacitor C3 is connected in series with capacitor C4. Since capacitor C3 is charged to the voltage developed by the cathode voltage multiplier 54 (cathode supply voltage), the combined voltage across the series combination (C3 and C4) is approximately equal to V(MCP IN) plus the cathode supply voltage. As the cathode switch 56 output swings from ground to the negative cathode voltage, the cathode terminal 16 is driven negative with respect to the MCP IN terminal 20 turning diode CR1 "off." This switching action of the cathode switch 56 causes the cathode tube capacitance, C(cathode), and capacitor C2 to also be placed in series with capacitors C3 and C4.

Figure 4:
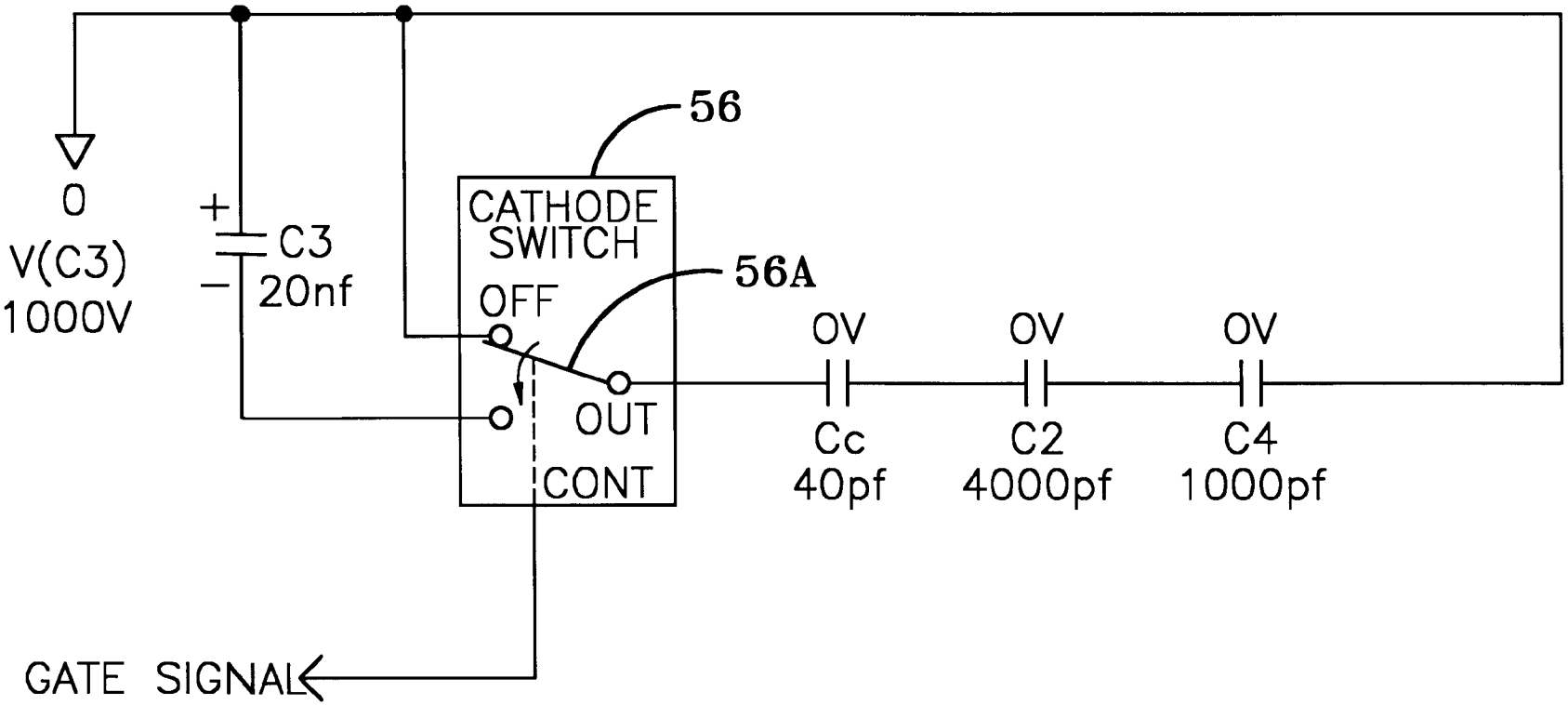
FIG. 4 is an equivalent diagram related to the arrangement of FIG. 3.

The equivalent circuit related to the operation of the cathode switch 56 is shown in FIG. 4 which also shows associated capacitance values. The circuit of FIG. 4 is used to determine the net charge re-distribution and voltage changes between the capacitors. Charge transfer equations are written in order to solve for the change in cathode voltage due to the switching action. The results of a related analysis is given in equation (1) below:

$$\Delta VC_c = \frac{VC3}{\left(1 + \frac{C_c}{C3} + \frac{C_c}{C2} + \frac{C_c}{C4}\right)} \tag{1}$$

The quantities shown in FIG. 4 are derived when it is assumed that a nominal cathode supply voltage of 1000 volts exists and which is generated by the cathode voltage multiplier 54. Substituting the capacitor values, shown in the example of FIG. 4, results in an increase in cathode voltage of 950 volts. Subtracting the "off" voltage of 20 volts gives an effective "on" voltage of 930 volts. The voltages on capacitors C3, C2, and C4 are reduced by 1.0 volts, 9.5 volts, and 38 volts, respectively. The details of the circuit switch 56 is shown in FIG. 5 composed of FIGS. 5(A), 5(B) and 5(C) and is comprised of a plurality of elements some of which have already been described and with the additional elements thereof given in Table 3.

TABLE 3

| ELEMENT | GENERAL DESCRIPTION/TYPE |
|---|---|
| PS1 | FLOATING POWER SUPPLY (+12 V D.C.) |
| PS2 | FLOATING POWER SUPPLY (+12 V D.C.). |
| U1 | SECOND OPTICAL COUPLER HCPL-5201 (HAVING RESET FUNCTION) |
| U2 | FIRST OPTICAL COUPLER HCPL-5201 (HAVING RESET FUNCTION) |
| U3 | SECOND DRIVER MIC 4426 AJ |
| U4 | FIRST DRIVER MIC 4427 AJ |
| Q1 | SECOND FIELD EFFECT TRANSISTOR (FET) MTP 3H120E |
| Q2 | FIRST FIELD EFFECT TRANSISTOR (FET) MTP 3H120E |
| R3 | 12M |
| R4 | 2K |
| R5 | 10K |
| R6 | 4.4M |
| R7 | 62Ω |
| R8 | 20Ω |
| R9 | 62Ω |
| R(MCP) | 200M |
| C5 | 0.082 $\mu f$ |
| C(CATHODE) | 40 pf |
| C(MCP) | 70 pf |
| C(SCREEN) | 12 pf |
| CR3 | ZENER DIN 4746 |
| CR4 | ZENER DIN 4746 |
| CR5 | ZENER VS 148 |

Figure 5B:
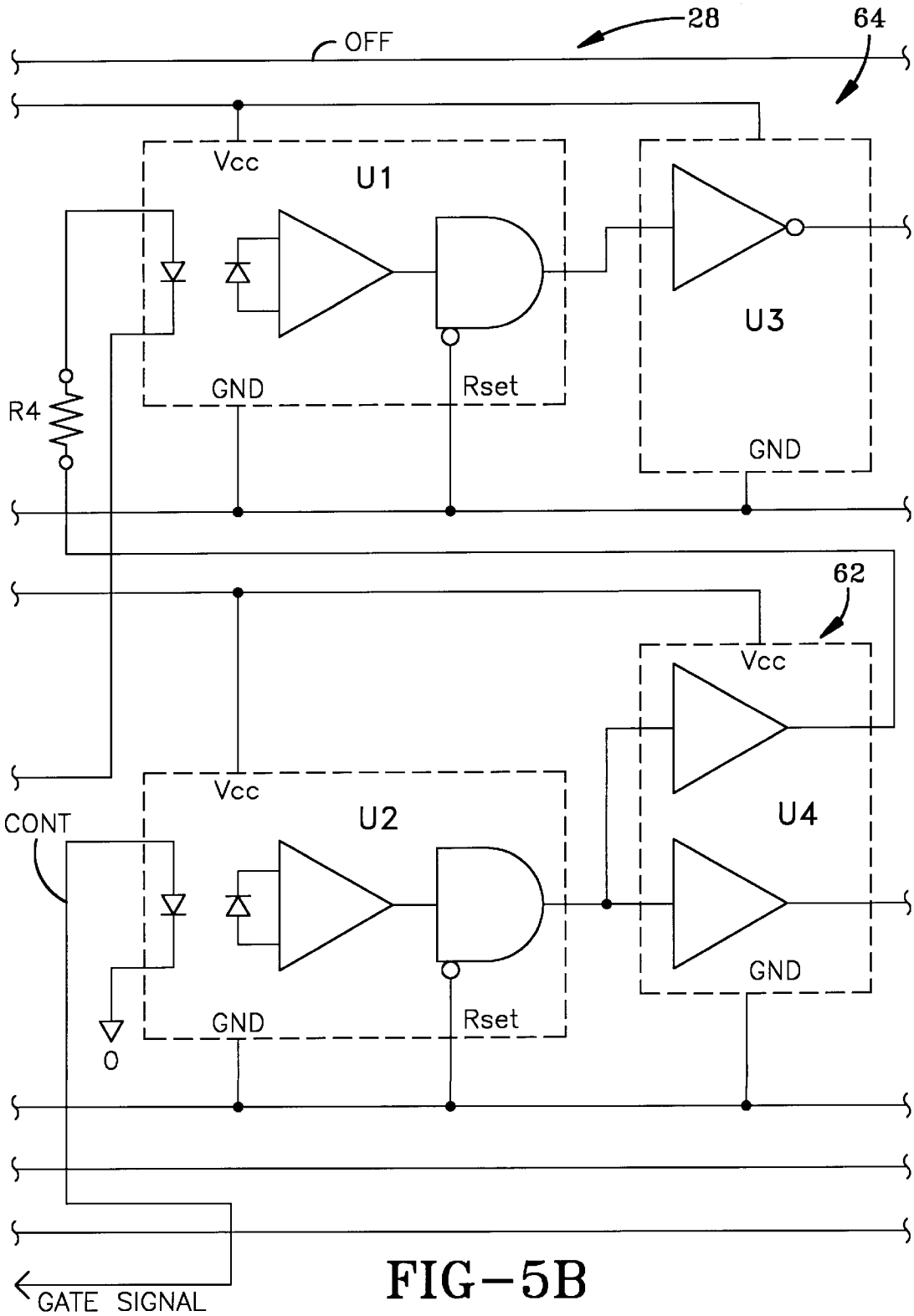
FIG. 5 is composed of FIGS. 5(A), 5(B) and 5(C) and is a schematic of the cathode switch of FIG. 3.
Figure 5C:
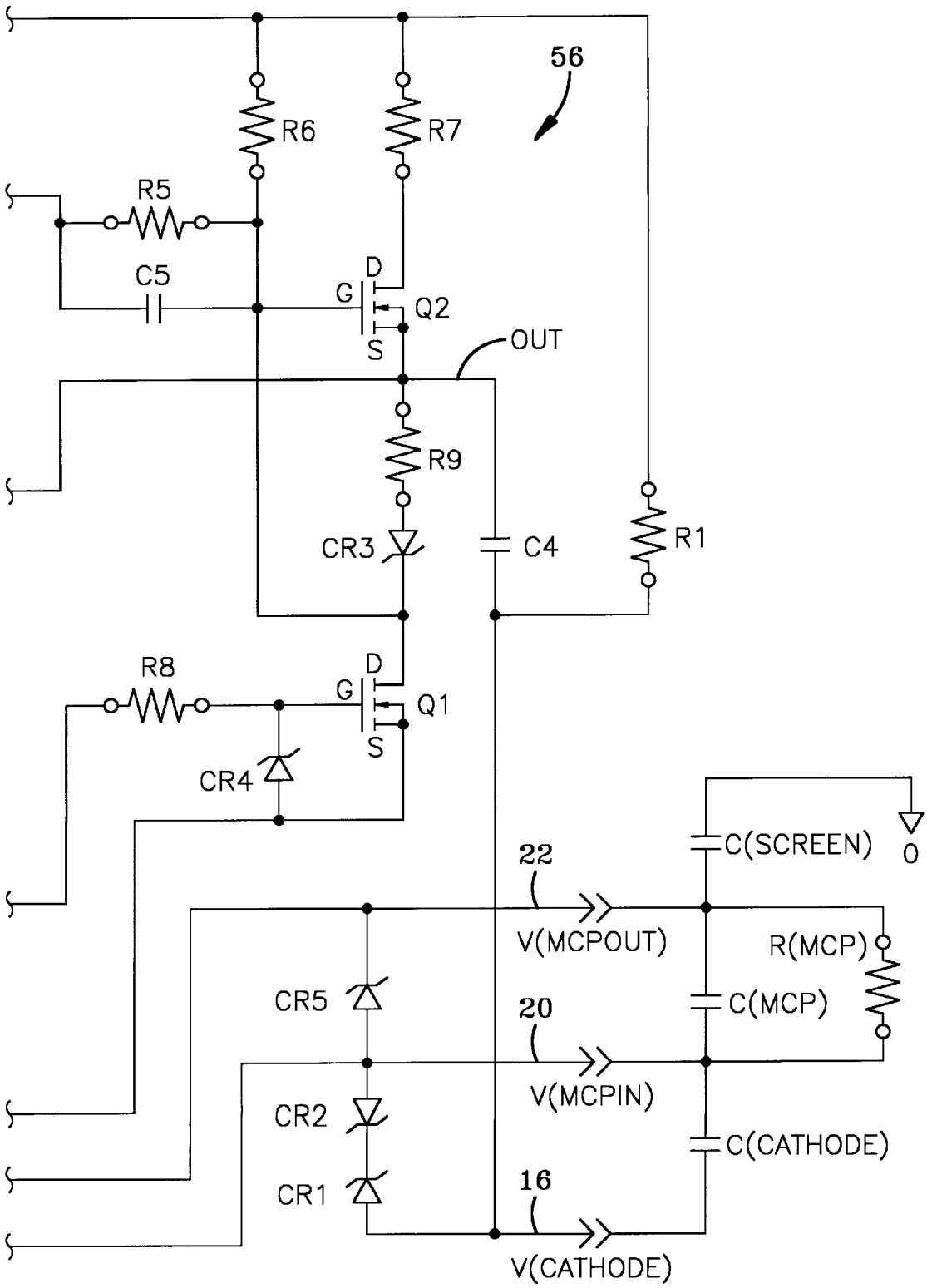

In general, as seen in FIGS. 5(B) and 5(C) the cathode switch 56 comprises a first arrangement 62 comprising a first optical coupler U2 having an input serving as the control (cont) terminal and being responsive to the gate signal and generating an output signal therefrom. The first arrangement 62 has a first driver U4 connected to receive the output signal of the first optical coupler U2 and, in response thereto, generates first and second drive signals. The first arrangement 62 has a first field effect transistor (FET) Q1 having gate, source and drain electrodes and being responsive to the first drive signal applied to its gate electrode. The source electrode of U1 serves as the ON position of the cathode switch 56.

The cathode switch 56 further comprises a second arrangement 64 having a second optical coupler U1 having an input connected to and being responsive to the second drive signal of the driver U4 and provides an output signal therefrom. The second arrangement 64 has a second driver U3 connected to receive the output signal of the second optical coupler U1 and, in response thereto, generates a third drive signal. The second arrangement 64 has a second field effect transistor (FET) Q2 having gate, source and drain electrodes and being responsive to the third drive signal of U1 which is applied to its gate electrode. The source electrode serves as the output terminal of the cathode switch 56 and is connected to the drain electrode of the first FET Q1 by way of a zener diode CR3, and the drain electrode of Q1 serves as the OFF position of the cathode switch 56.

The second arrangement 64 further comprises a second floating power supply (PS2) having a positive and negative terminal and the first optical coupler U2 includes an input state comprising a light emitting diode having one of its ends connected to the negative terminal of the second floating power supply PS2. In addition, it is desired that the cathode switch 56 include a first floating power PS1 arranged as shown in FIG. 5. The first and second optical couplers U2 and U1 each have a reset (Rset) input. The circuit switch 56 further comprises a plurality of components, such as R3 arranged as shown in FIG. 5(A).

The two high voltage FETS, Q1 and Q2, shown in FIG. 5(C) are utilized in the output switching stage in a special anti-current spiking configuration. FET Q1 is normally "off," and there is no current flowing in diode CR3. Under these bias conditions, the gate of FET Q2 is pulled-up to ground potential by resistor R6, which turns FET Q2 "on." The source of FET Q2 is nearly at ground so high voltage capacitor C4 is charged to the V(MCP IN) potential at terminal 20. Resistor R6 has a relatively large time constant associated with it, so the turn "on" response of this circuit is relatively slow. The primary purpose of FET driver U3 is to provide high speed response during the turn "on" of FET Q2. However, during static conditions, FET driver U3 provides additional "on" bias to FET Q2 via resistor R5. This additional drive essentially guarantees that FET Q2 is fully "on" which ensures that the positive terminal of capacitor C4 is at ground potential.

In operation, and with simultaneous reference to FIGS. 5(A), 5(B) and 5(C) the cathode switch 56 is turned "on" by applying a current pulse to the LED drive input. More particularly, the cathode switch 56 is rendered conductive by applying a current pulse, serving as a gate signal, to the input stage of the optical coupler U2. Integrated circuit U2 is an optocoupler which is used to couple the drive pulse from ground potential (external device) to the negative cathode potential of the cathode switch 56. This voltage is nominally a negative 1000 volts for one application. The current drive pulse from the external device causes the output of the optocoupler U2 to go high. This signal is coupled to both inputs of integrated circuit U4 which is a dual, non-inverting FET driver. The output of the FET driver U4, via resistor R8, controls the gate of FET Q1. The low or zero volt, output holds the FET Q1 "off." When the gate driver U4 output swings to its high value, which is approximately 12 volts, FET Q1 is turned "on." Load current flows through diode CR3 in the forward direction into the drain of FET Q1. Since diode CR3 is in parallel with the gate to source input of FET Q2, forward biasing of CR3 causes FET Q2 to turn "off." Turn "on" time depends on the switching speeds of diode CR3 and the two FETs. Since all of these devices have extremely fast response times, turn "on" of the output switch, representative of the output of the cathode switch 56, is very rapid with the output swinging nearly 1000 volts in less than 50 nanoseconds.

Another output of FET driver U4 supplies a current pulse to the LED input of optocoupler U1, that is, to the input stage of the optocoupler U1. Integrated circuits U1 and U3 are powered by floating power supply PS1 which is referenced to the source of FET Q2. The circuitry of U1 and U3 swings between ground and the negative cathode voltage in their operative states. The optocoupler U1 is desired for voltage isolation of the drive signal which is referenced to the negative cathode voltage, that is, the terminal 60 of the cathode voltage multiplier 54. The input current pulse causes the output of U1 to go high which drives the FET driver U3 input low. This signal of U3, which is delayed by the propagation time of the two integrated circuits (U1 and U3), serves to hold FET Q2 "off" during steady state conditions. The forward current through diode CR3 consists only of the transient load current which is desired to discharge capacitor C4. When the discharge transient is over, diode CR3 turns "off."

In operation, when the external LED drive current pulse ends, that is, when the gate signal applied to the cathode switch 56 terminates, the output of optocoupler U2 goes low initiating the turn "off" sequence of the IIT tube 12. The output of FET driver U4 goes low turning FET Q1 "off," via resistor R8 and the gate (G) electrode of FET Q1. The propagation time from the input of U2 to the output of driver U4 is nominally 300 nanoseconds. The drive signal applied to the gate of FET Q2, is delayed by an additional 300 nanoseconds by way of elements U1 and U2. During this time both of the FETs Q1 and Q2 are "off." When FET Q2 is turned "on," FET Q2 pulls the output positive until the output of FET Q2 at source electrode S is back to ground potential recharging capacitor C4 in the process. Both FETs, Q1 and Q2, however, may have relatively large non-linear gate-to-drain capacitances which should be charged and discharged during turn "on" and turn "off" of the output circuit. This complication is most severe during turn "off" of the IIT 12. More particularly, when FET Q2 pulls the output high, a relatively large current flows into the drain electrode of FET Q1. This current charges the gate-to-drain capacitance from its initial value of approximately zero volts to its final "off" value of nearly 1000 volts. The sink for this current is the output circuit of FET Q1 driver U4. The FET Q1 source to drain voltage should remain below the threshold voltage in order for the device not to be driven back "on" by the charging current. This suggests that the FET Q1 driver U4 has a very low output impedance.

The resistor R8 at the output stage of U4 is desired so as to prevent oscillation of the FET Q2 input-driver output circuit combination. In addition, resistors R7 and R9 are desired to limit the peak current to an acceptable value which is approximately 6 amps for the implementation of one embodiment of the present invention.

Figure 6:
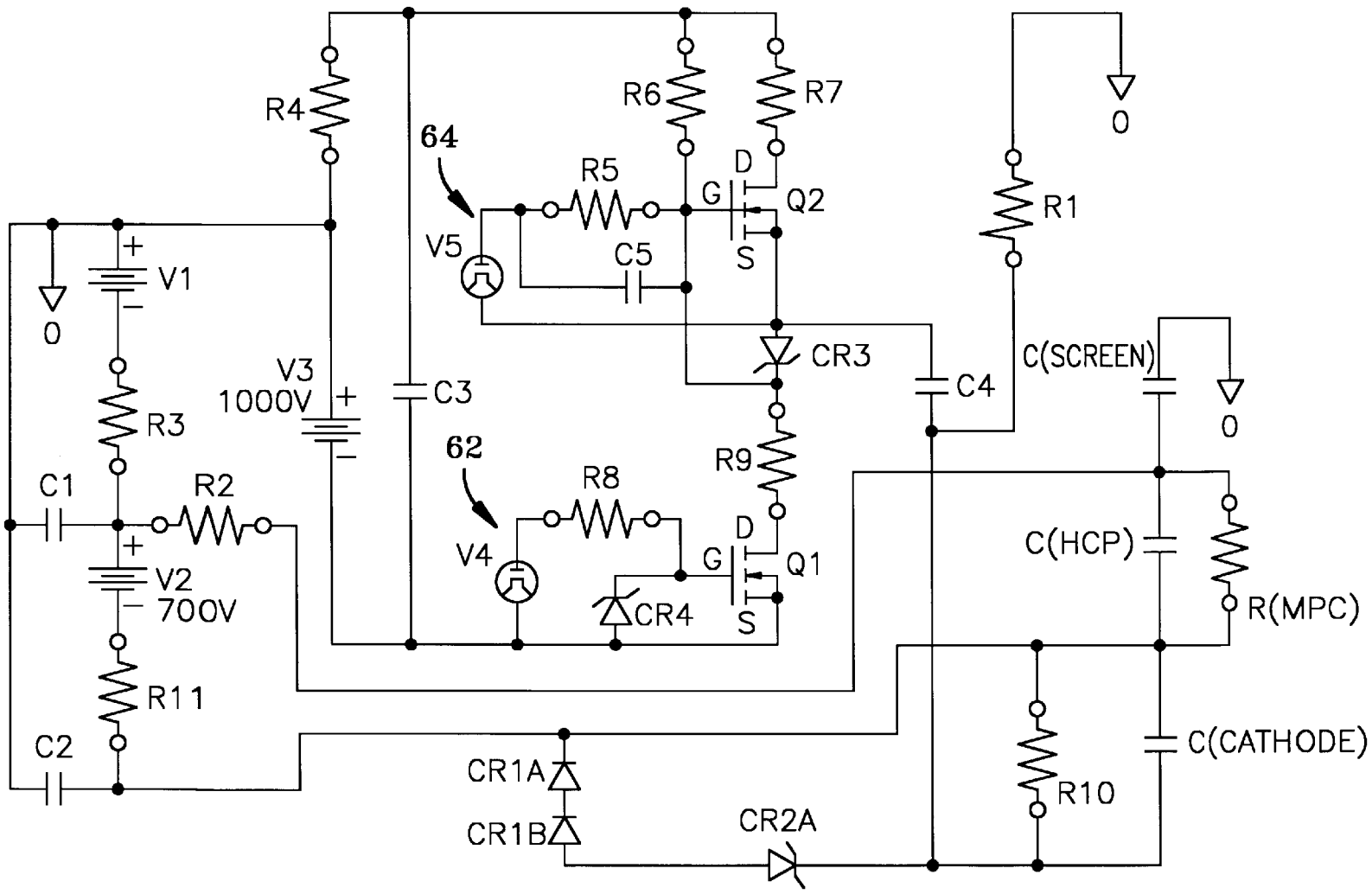
FIG. 6 is a schematic of a circuit used to simulate the circuit of FIG. 3.

In the practice of this invention a Pspice simulation, known in the art, was performed using the circuit arrangement of FIG. 6, wherein the first and second arrangements 62 and 64 are also shown as V4 and V5 respectively and which is comprised of a plurality of elements most of which have already been described, but with the additional elements given in Table 4.

TABLE 4

| ELEMENT | DESCRIPTION |
|---|---|
| CR1A | DIODE DIN4937 |
| CR1B | DIODE DIN4937 |
| CR2A | DIODE DIN4749 |
| R10 | 10M |
| R11 | 100K |
| Q1A | FIELD EFFECT TRANSISTOR (FET) MTP3N 100/NC |
| Q2A | FIELD EFFECT TRANSISTOR (FET) MTP3N 100/NC |
| V1 | POWER SUPPLY 6000 V D.C. |
| V2 | POWER SUPPLY 700 V D.C. |
| V3 | POWER SUPPLY 1000 V D.C. |

Figure 7:
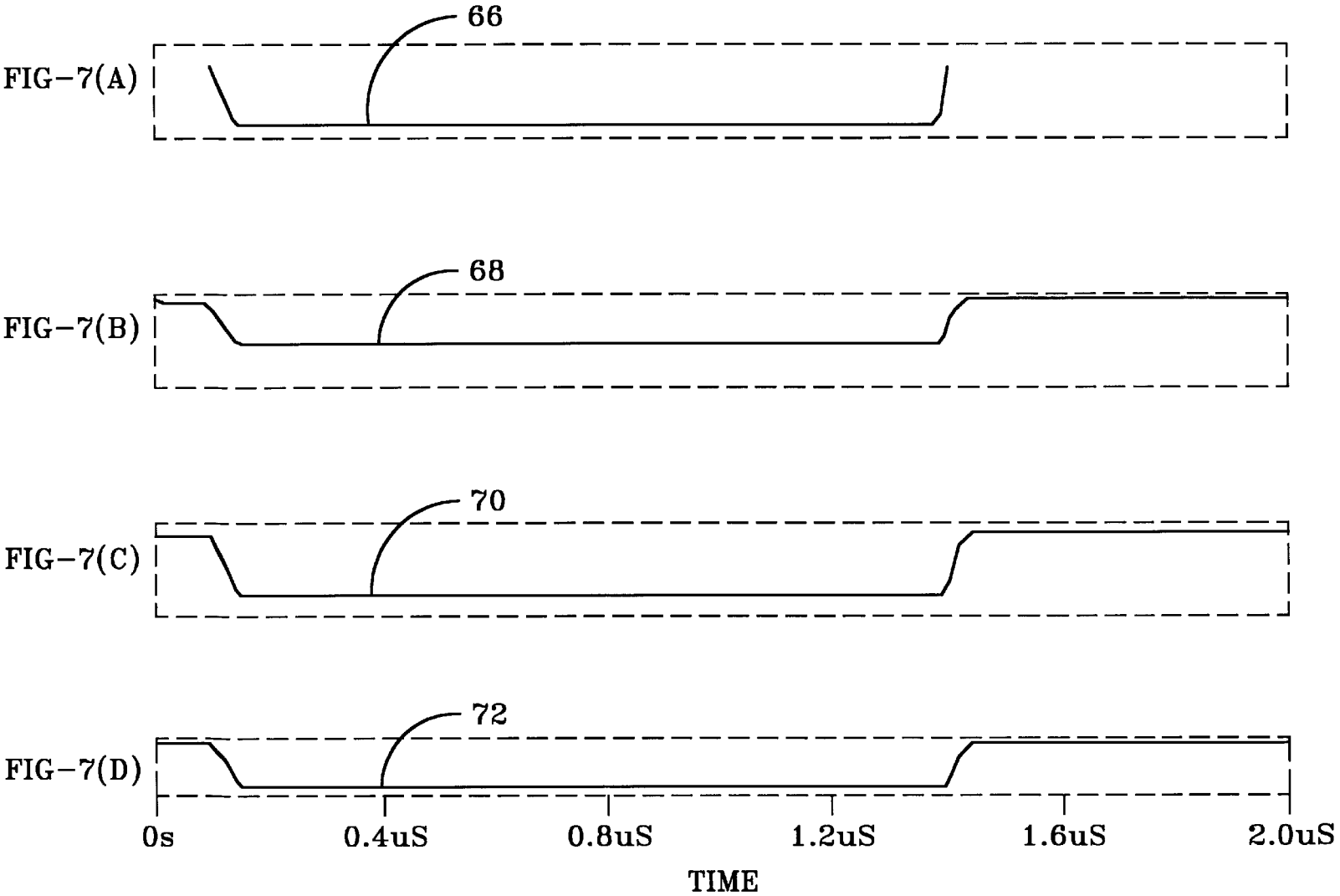
FIG. 7 is composed of FIGS. 7(A), 7(B), 7(C) and 7(D) and illustrates various waveforms involved in the operation of the present invention.

The circuit of FIG. 6 yielded simulated results that agree very closely with calculated values and actual circuit test data. The simulated output switch waveforms are shown in FIG. 7 composed of FIG. 7(A) illustrating a plot 66; FIG. 7(B) illustrating a plot 68; FIG. 7(C) illustrating a plot 70 and FIG. 7(D) illustrating a plot 72. The X axis of FIGS. 7(A)–7(D) is time given in $\mu$seconds and the Y axis of FIGS. 7(A) and (7B) is given in voltage.

FIG. 7(A) shows the cathode switch output waveform 66 which has an amplitude of 999.7 volts. The MCP IN voltage (terminal 20 of FIG. 1) is shown in FIG. 7(B) for plot 68. The simulation value of MCP IN voltage is 9.71 volts which can be favorably compared to the calculated value of 9.5 volts. The voltage waveform from cathode to MCP IN (between terminals 16 and 20 of FIG. 1) is present in FIG. 7(D). The simulated value of this voltage between terminals 16 and 20 is 951 volts, and the voltage calculated from the charge analysis is 950 volts. Similarly, the results obtained from the detail simulation of the cathode switch 56 itself were completely consistent with the calculated and measured data.

In the practice of the present invention, the circuit arrangement of FIG. 5, that is, the high voltage power supply 28, was tested. The floating power supplies of FIG. 5 were implemented with single stage diode-capacitor voltage multipliers which are driven from floating transformer secondaries. The cathode multiplier is typically a two stage unit which shares its drive signal with the screen voltage multiplier. A d-c cathode multiplier voltage of 913 volts was measured and the results thereof are shown in FIG. 8 comprised of FIG. 8(A) showing a plot 74 and FIG. 8(B) showing a plot 76.

FIG. 8(A) shows the voltage waveform plot 74 which was measured at the output (OUT) terminal of the cathode switch 56. FIG. 8(B) shows the cathode voltage pulse represented by plot 76, referenced to ground. The results of the testing are further shown in FIG. 9 for a plot 78.

Figure 9:
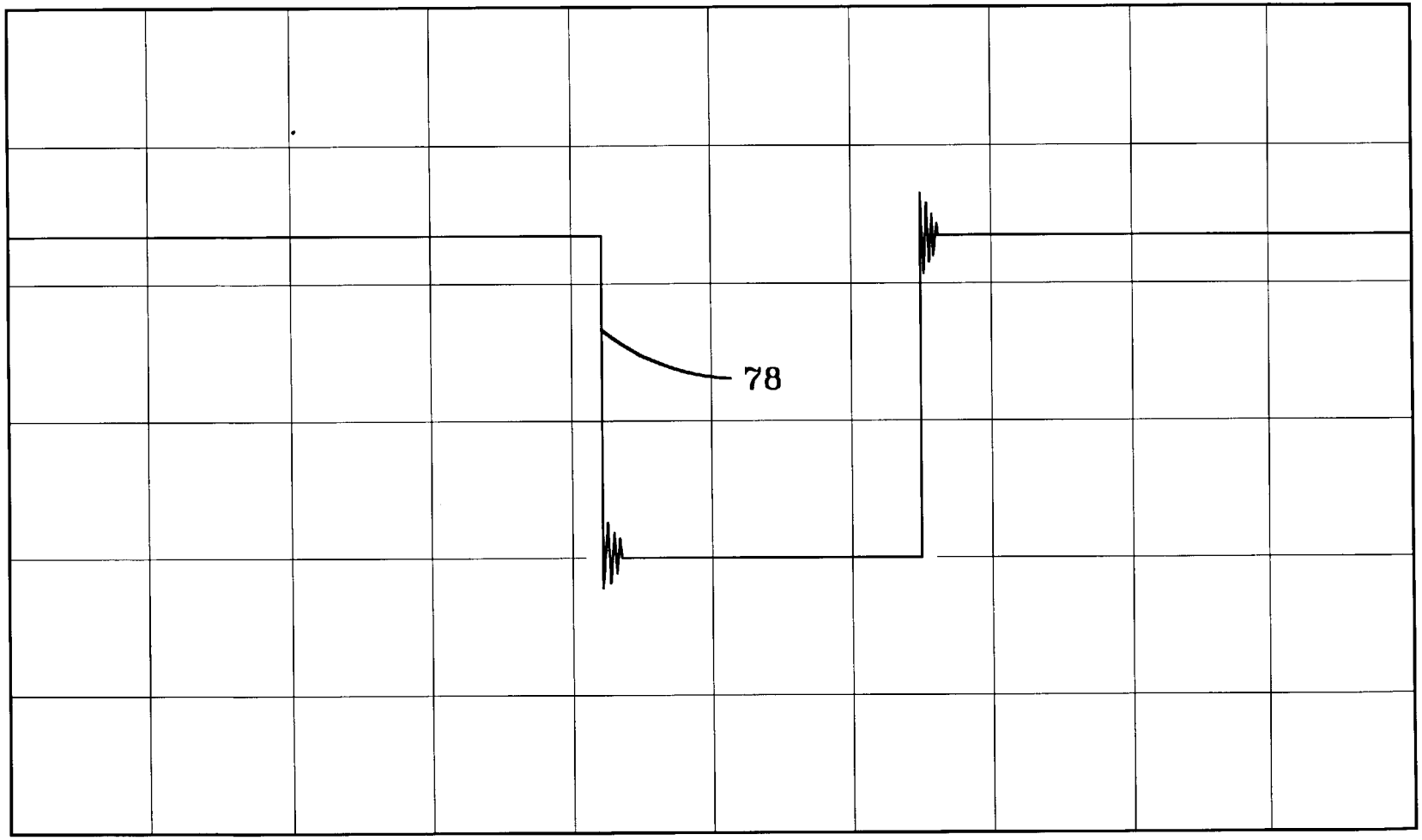
FIG. 9 illustrates a waveform involved in the analysis of the cathode switch of the present invention.

The voltage waveform in FIG. 9 is the result of subtracting the MCP IN voltage (that is, voltage at terminal 20) from the cathode voltage (that is, voltage at terminal 16). In the testing that was performed, high voltage capacitive divider probes were used to obtain these waveforms so there is no d-c information. A battery powered oscilloscope was floated with respect to the MCP IN voltage. Results of these measurements verified the d-c performance as well as the transient performance. To summarize, numerous detail measurements were made under various operating conditions at every circuit node, and in all cases the measured data agreed very closely with calculated and simulated results.

It should now be appreciated that the present invention provides a cathode switch that supplies a cathode pulse amplitude of nearly 1000 volts. It should be further appreciated that the features of this invention include: the referencing of the cathode circuit to ground, the non-spiking high voltage FET output stage, and the coupling of the pulse to the cathode output terminal, via a high voltage capacitive network. Some of the advantages yielded by this invention are: minimum number of components at high voltage, low voltage interfacing of input power and signal lines to cathode switch circuit, switching generated interference minimized, low power consumption, fault tolerant, and reduced complexity. This invention provides an efficient and reliable means for high speed gating an image intensifier tube.

It should be still further appreciated that the present invention is comprised of a cathode switch circuit referenced to ground; a high voltage, anti-spiking, semiconductor switch output stage; and a high voltage capacitive coupling network. Variations on this design include; referencing the negative cathode switch circuit bus to ground, use of other solid state switching devices such as bipolar transistors, use of multiple series switching devices, use of other methods such as transformer coupling to isolate the input drive signals, use of other driver interface circuits, and other minor changes in the implementation.

Various additional modifications will become apparent to those skilled in the art. All such variations which basically rely on the teachings to which the invention has advanced the art and properly considered within the scope of this invention.

What I claim is:

1. A vision system comprising:

(a) an image intensifier tube having four terminals and comprising:

(i) a photocathode having a first terminal at one of its ends;

(ii) a micro channel plate having second and third terminals at one of its ends; and (iii) an anode having a fourth terminal at one of its ends; and (b) a high voltage power supply comprising:

(i) a micro channel plate voltage multiplier having positive and negative terminals and developing a voltage between its positive and negative terminals, said negative terminal thereof being connected to said second terminal of the micro channel plate and said positive terminal thereof being connected to said third terminal of said micro channel plate by way of a capacitor C1 and resistor R2 each having a first end connected to said positive terminal and with the second end of capacitor C1 connected to a ground potential and the second end of resistor R3 connected to said third terminal, said negative terminal thereof being further connected to one end of a capacitor C2 which has its other end connected to a ground potential;

(ii) a pair of oppositely poled diodes CR1 and CR2 with one end of said pair connected to said first terminal of said photocathode and the other end of said pair connected to said second terminal of said micro channel plate;

(iii) a screen voltage multiplier developing a negative voltage at one of its terminals connected to the first side of said capacitor C1, said screen voltage multiplier having a ground potential at another one of its terminals;

(iv) a cathode voltage multiplier having a ground (gnd) and a negative (−) terminal and developing a negative voltage between said negative and ground terminals and having a capacitor C3 arranged across its negative and ground terminals;

(v) a cathode switch having a common and a control terminal, said common having a first and second end with the first end an output terminal connected to said first terminal by way of a capacitor C4 and its second end switchable between ON and OFF positions in response to a gate signal applied at said control terminal, said ON position connected to said negative terminal of said cathode voltage multiplier and said OFF position connected to said first terminal by way of a resistor R1.

2. The vision system according to claim 1, wherein said cathode switch comprises:

(a) a first arrangement comprising;

(i) a first optical coupler having an input serving as said control terminal and being responsive to said gate signal and generating an output signal;

(ii) a first driver connected to receive said output signal of said first optical coupler and, in response thereto, generating first and second drive signals; and (iii) a first field effect transistor (FET) having gate, source and drain electrodes and being responsive to said first drive signal applied to its gate electrode, said source electrode serving as said ON position of said cathode switch;

(b) a second arrangement comprising:

(i) a second optical coupler having an input connected to and being responsive to said second drive signal and providing an output;

(ii) a second driver connected to receive said output of said second optical coupler and, in response thereto, generating a third drive signal;

(iii) a second field effect transistor (FET) having gate, source and drain electrodes and being responsive to said third drive signal applied to its gate electrode, said source electrode serving as said output terminal of said cathode switch and connected to said drain electrode of said first FET by way of a zener diode, and said drain electrode serving as said OFF position of said cathode switch.

3. The vision system according to claim 2, wherein said second arrangement further comprises a second floating power supply having a positive and negative terminal and said first optical coupler includes an input state comprising a light emitting diode having one of its ends connected to said negative terminal of said second floating power supply.

* * * * *